United States Patent [19]

Brownbill

[11] 4,220,250

[45] Sep. 2, 1980

[54] CLOSURE FOR CONTAINERS

[75] Inventor: Thomas D. Brownbill, West Bromwich, United Kingdom

[73] Assignee: Metal Closures Group Limited, West Bromwich, England

[21] Appl. No.: 27,593

[22] Filed: Apr. 5, 1979

Related U.S. Application Data

[63] Continuation of Ser. No. 882,200, Feb. 28, 1978, abandoned.

[30] Foreign Application Priority Data

Dec. 5, 1977 [GB] United Kingdom ..... 50545/77

[51] Int. Cl.[2] ..... B65D 53/00

[52] U.S. Cl. ..... 215/270; 215/344; 215/DIG. 1

[58] Field of Search ..... 215/260, 341, 344, DIG. 1

[56] References Cited

U.S. PATENT DOCUMENTS

| | | | |
|---|---|---|---|
| 3,203,571 | 8/1965 | Plunkett | 215/DIG. 1 |
| 4,061,240 | 12/1977 | Brownbill | 215/344 X |
| 4,122,965 | 10/1978 | Roy | 215/344 |

FOREIGN PATENT DOCUMENTS

| | | | |
|---|---|---|---|
| 1485328 | 5/1967 | France | 215/341 |
| 1205887 | 9/1970 | United Kingdom | 215/341 |

*Primary Examiner*—Donald F. Norton

*Attorney, Agent, or Firm*—Stevens, Davis, Miller & Mosher

[57] ABSTRACT

The present invention relates to a closure for a container the contents of which are to be pressurized characterized by having a crown and a depending skirt, retaining means provided in or on said skirt adapted to co-operate with a neck of the container to which the closure is to be applied, a flexible annular sealing ring extending from an internal surface of the closure adapted to engage in sealing relationship with a container neck and a support ring depending from the crown of the closure and disposed substantially concentrically within the sealing ring and arranged to limit the flexing of the sealing ring relative to the axis of the closure whereby the pressure of the contents of the container permeates between the support of the sealing rings to urge the ring into sealing engagement with the neck of the container to which the closure is applied the skirt has a bead at the level of the sealing ring extremity to center the closure on the neck as the sealing ring and neck are brought into sealing engagement.

5 Claims, 3 Drawing Figures

CLOSURE FOR CONTAINERS

This is a Continuation of application Ser. No. 882,200 filed Feb. 28, 1978, Now abandoned.

The present invention relates to closures and has particular reference to closures adapted to be applied to containers of the type to be used in the packaging of pressurised goods, and having a dispensing opening. Typically, such containers are formed of glass and usually have a neck portion having a screw thread adapted to receive a screw-threaded type closure. These containers generally contain gasified contents such, for example, as lemonade, tonic water and soda water.

At the present time, these containers are generally provided with metal closures which have a sealing wad in the cap itself so that on application of the closure to the bottle or container, interaction of the screw thread between the closure and the container draws the closure down onto the neck of the container so that the wad engages the rim of the container neck to deform the same and to effect a seal between the wad and the container itself. The manufacture of such articles involves the formation of the closure, the formation of the wad and then the insertion of the wad into the closure. These closures have been used for many years and have proved to be generally satisfactory. They are, nevertheless, becoming increasingly more expensive to manufacture and in consequence there is a considerable advantage in producing a closure more readily formed of a plastics material.

Many attempts have been made to produce a suitable closure of plastics material but they all result in a limited degree of leakage due to imperfect sealing between the plastics material itself and the neck of the container where the neck of the container has a slight imperfection, and is not completely regular in shape and form.

According to the present invention there is provided a closure for a container, the contents of which are to be pressurised, which closure comprises a crown and a depending skirt, retaining means provided in or on said skirt and adapted to co-operate with the neck of the container to which the closure is to be applied, a flexible annular sealing ring extending from an internal surface of the closure and adapted to engage in sealing relationship with the container neck, and a support ring depending from the crown of the closure and disposed substantially concentrically within said sealing ring and arranged whereby when applied to a container neck the extremity of the support ring abuts a surface of the sealing ring to restrain flexing of the sealing ring beyond the perpendicular to the closure axis.

The arrangement is preferably such that the pressure of the contents of the container permeates between the abutting support ring and sealing ring to urge the sealing ring into further sealing engagement with the neck of the container to which the closure is applied.

In one embodiment of the present invention there is provided an inwardly projecting annular bead which, when the closure is applied to a container is adapted to abut the surface of the neck thereof juxtaposed the rim defining the dispensing opening. This feature has the advantage of centreing the closure on the container neck as the components are brought into sealing engagement and at the same time serves to take up and deform in response to any slight irregularity in the finish of the container neck itself.

The sealing ring may be a flexible annular ring extending inwardly from the crown and/or the skirt of the closure, and it is preferred that the sealing ring extends inwardly from the junction of the crown of the skirt to define a ring of generally frusto-conical form which decreases in overall diameter with increasing spacing from said crown.

The outer extremity of the ring on that portion adapted to engage the neck of the container may have an annular sealing member. The annular sealing member may itself include a sealing surface adapted to engage the rim of the container neck and the sealing surface may carry one or more ribs each adapted to make line contact with the neck of the container.

The pressure of the contents of the container are arranged to act upon the sealing ring by permeating between the abutting surfaces of the support ring and the back of the sealing ring when the closure is in sealing engagement with the container. The imperfections between the sealing ring and the support ring are sufficient to allow the pressure to build up in the annular space defined by the support ring, the crown, the skirt and the "back" of the sealing ring so that said additional pressure serves to urge the ring into further sealing engagement with the neck of the container. This additional sealing occurs by further flexing of the sealing ring into slow pressure area of the closure towards the skirt.

A sealing surface may be provided on the internal surface of the skirt and may gradually decrease in diameter in a direction towards the crown. The decrease in diameter is preferably progressive, that is to say non-regular so that the sealing surface passes about a corner defined by either the junction of the crown and the skirt or the projection of the annular sealing ring into a smooth configuration and extends inwardly of the internal generally cylindrical surface of the skirt to engage with the rim of the container to which the closure is to be applied.

The closure is preferably formed of resilient plastics material and the retaining means may be a screw thread on the internal surface of the skirt adapted to co-operate with the corresponding thread provided on the external surface of the container neck. The external surface of the skirt itself may be provided with a knurled portion to assist gripping and manipulation of the closure.

In use, application of the closure to the neck of the container results in engagement between the threads on the skirt and the container neck so that rotation of the closure relative to the container neck draws the closure progressively onto the container. Continued application of the closure to the container neck brings the rim of the container initially into contact with the sealing surface of the sealing ring of the closure and then urges the rim of the container neck into sealing engagement therewith to deform the sealing ring and effect a seal between the surface and the rim itself. At the same time the upper extremity of the container neck engages the inwardly directed annular bead and serves to locate and centre the closure before maximum closure and sealing torque is finally applied to the closure itself. The depth of the support ring is arranged so that the sealing ring is brought into abutting engagement therewith without the sealing surface being flexed through an angle such that the sealing surface passes through the perpendicular to the axis of the closure. With this arrangement the harder the closure is applied to the container the greater is the sealing force applied directly to the sealing ring.

Imperfections between the sealing ring and the support ring may serve to allow permeation of pressurised gas into the annulus defined by the back of the sealing ring, the adjacent portions of the skirt and crown of the closure and the annular support ring thereby causing further flexing of the ring radially outwardly of the support ring to increase the sealing engagement one with the other.

In accordance with a preferred embodiment of the present invention, the higher the pressure of the contents the more effective the sealing of the sealing ring while an interference fit is also obtained between the annular bead and the neck of the container.

Following is a description by way of example only with reference to the accompanying drawings in embodiment of the closure in accordance with the present invention.

Figure 1:
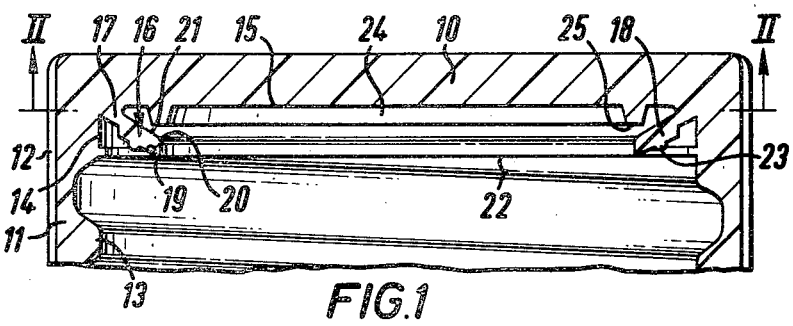
FIG. 1 is a section of the closure in accordance with the present invention.
Figure 2:
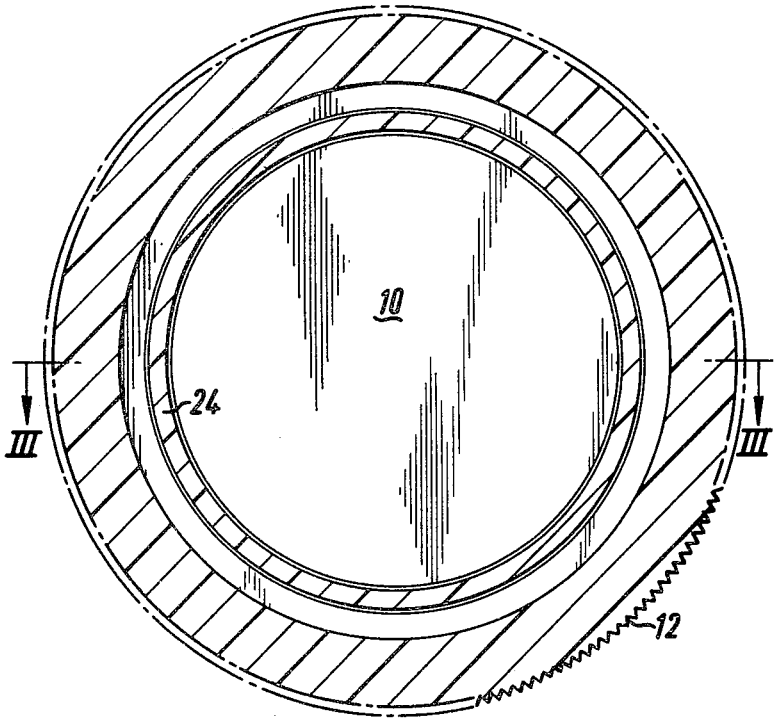
FIG. 2 is a section on the lin II:II of closure FIG. 1.
Figure 3:
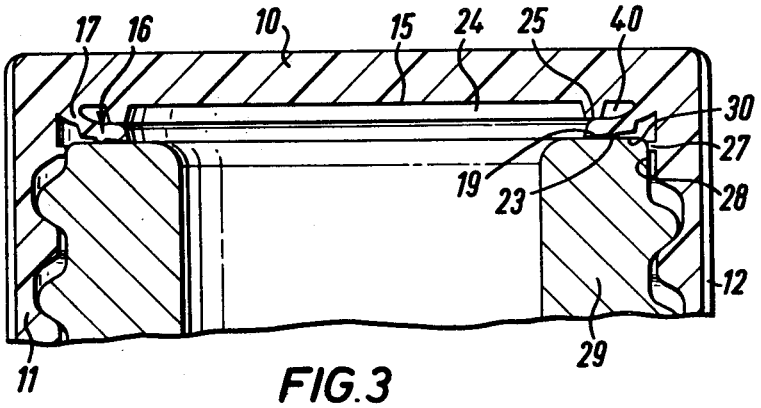
FIG. 3 is a section along the lines III:III of closure FIG. 2.

The closure illustrated comprises a substantially circular disc 10 constituting the crown of the closure and the periphery of the disc 10 carries integrally therewith, a depending skirt 11 which is knurled on its outer surface 12 for ready engagement and ease of gripping by the user.

The internal surface of the skirt 11 is provided with a screw thread 13 and the junction between an internal surface 14 of the skirt and the inner surface of the crown 15 is provided with a generally frusto-conical inwardly directed flexible ring 16. The ring 16 juxtaposed the junction of internal surface 14 and inner surface 15 comprises a first flexible portion 17 and a second outer sealing member 18. The second outer sealing member 18 has a lower sealing surface 19 and an upper curved surface 20 merging continuously with a back surface 21. The upper curved surface 20 and the sealing surface 19 together define an annular extremity 22 of the ring and the lower sealing surface has an annular bead 23.

The crown of the closure constituted by disc 10 carries an annular support ring 24 generally concentric with the disc 10 and spaced inwardly of the junction of sealing ring 16 with the crown and the skirt. The annular support ring depends from the inner surface 15 of the crown and is generally trapezoidal in cross-section decreasing in cross-section in a direction downwardly and away from the crown. The annular support ring has a substantially annular surface 25 which is adapted to engage with and abut the back surface 21 of the sealing ring when the latter is flexed.

Towards the junction of the sealing member 17 with the skirt 11 there is provided in the surface of the skirt above the upper extremity of the thread 13 a radially inwardly directed bead 27 which is adapted to engage with and abut the periphery 28 of neck 29 juxtaposed the annular neck rim 30.

In use, the closure is applied to the neck 29 of the container by engaging the screw thread 13 on the internal surface of the skirt 11 and corresponding thread 31 on the external surface of neck 29. By screwing the closure onto the container neck 29 of the extremity 22 of the sealing ring 16 is brought into contact with rim 30 defining the extremity of the container neck. Continued application of the closure results in flexing of the flexible portion 17 of the ring 16 to bring the lower sealing surface 19 into juxtaposition with rim 30 with the annular bead 23 carried by lower sealing surface 19 in abutting relationship with the juxtaposed portion of rim 30.

As the closure is screwed onto the container neck, the rim 30 enters within radially inwardly directed bead 27 until the outer surface abuts said bead 27. The closure is then located and centred by bead 27 as final tightening of the closure is completed. The closure is tightened down until the back surface 21 of sealing ring 16 abuts the annular surface 25 of support ring 24 to positively urge sealing ring into sealing engagement with the rim 30 of the neck 29 of the container.

In this condition, the generation of pressure within the container itself results in an increase in pressure within the container. The increase in pressure will tend to permeate between the annular support ring 24 and the sealing ring 16 to enter the annulus 40 and to exert pressure on the first flexible portion 17 and the back surface 21 of sealing ring 16 thus enhancing the sealing engagement between member 18 and the rim 30 of the container to which the closure is employed.

It will be appreciated that the flexible portion 17 of the sealing ring 16 is urged and flexed into the relatively low pressure area defined between the outer surface of the rim 30 of the container and the inner surface of the skirt carrying the threads 13.

The closure described above was attached to a test ring including a suitable neck and applied with a torque of 20 lb/inches. A pressure of 160 lbs. per sq. inch was applied to the inside of the container neck and was maintained for 2 minutes. The removal torque after release of the pressure was 11 to 12 lb./inches.

A container was filled with carbonised water and the above closure applied with a torque of 20 lb/inches. The container was shaken continuously for 14 days and the container referred to above was then stored lying on its side for 80 days. In each case no leakage was noted.

It will be appreciated that the closure described above may be manufactured of any suitable resilient thermoplastics material and depending on the contents of the container, materials such as polypropylene and modified polyethylene being found to be particularly successful. Closures manufactured in accordance with the present invention have been tested with water under laboratory conditions of pressures in excess of 50 lb. per sq. inch without leaking. It will be appreciated, however, that the degree of pressure seal obtained is dependent on the nature of the plastics material employed, the nature of the contents of the container and the material and uniformity of the sealing surfaces of the container itself. The closures in accordance with the present invention permit the formation of a onepiece pressure resistant closure from a plastics material without the use of a separate sealing wad. The free end of the closure skirt may carry an annular tear strip which is dimentioned to embrace a portion of the container neck. The arrangement may be such that co-operation between the neck and the tear strip portion can preclude unauthorised separation of the closure and container, since detachment of the tear strip from the skirt will indicate that the contents of the container may have been sampled.

A further advantage of the present invention is that in addition to its ready use in conjunction with pilfer proof type of tear strip arrangement imperfections in the dimensions of the container neck are taken care of by the centreing effect of the bead 27.

I claim:

1. A closure for a container the contents of which are to be pressurized characterized by having a crown and a depending skirt, retaining means associated with said skirt adapted to cooperate with a neck of the container to which the closure is to be applied, a flexible annular sealing ring extending from an internal surface of the closure adapted to engage in sealing relationship with a container neck and a continuous support ring depending from the crown of the closure and disposed substantially concentrically within the sealing ring and dimensioned to limit the flexing of the sealing ring relative to the axis of the closure whereby the pressure of the contents of the container permeates between the support and the sealing rings to urge the ring into sealing engagement with the neck of the container to which the closure is applied, said skirt being further characterized by having an inwardly projecting annular bead disposed about the internal surface of the skirt at the level of the extremity of the sealing ring and adapted when the closure is applied to a container neck to abut the surface of the neck to center the closure on the container neck as the sealing ring and container neck are brought into sealing engagement.

2. A closure as claimed in claim 1 characterized in that the annular sealing ring includes a sealing surface adapted to engage the rim of the container neck.

3. A closure as claimed in claim 2 characterized in that the sealing surface carries one or more ribs concentric with the sealing surface to make line contact with the neck of the container.

4. A closure as claimed in claim 1 characterized in that the annular support ring depends from the inner surface of the crown and is generally trapezoidal in cross-section decreasing in cross-section with increasing spacing from the crown.

5. A closure cap in combination with a container containing a pressurized fluid, said container having a neck provided with a dispensing opening; said cap comprising a crown and an annular skirt depending from the crown;

means associated with the skirt for securing the cap to the container neck with the crown disposed across the dispensing opening;

a flexible annular sealing ring integral with the crown and inclined radially inwardly therefrom in sealing contact with the container neck around the said dispensing opening;

a continuous annular support ring depending from the crown within the space between said sealing ring and the inner surface of the crown whereby the sealing ring is pressed there against when the sealing ring engages the container, whereby fluid under pressure in the container permeates between the support ring and sealing ring to urge the sealing ring into sealing engagement with the neck of the container; and an inwardly projecting annular bead disposed about the internal surface of the skirt at the level of the extremity of the sealing ring and adapted when the closure is applied to a container neck to abut the surface of the neck to center the closure on the container neck as the sealing ring and container neck are brought into sealing engagement.

* * * * *